US007484261B2

(12) United States Patent
Sigl et al.

(10) Patent No.: US 7,484,261 B2
(45) Date of Patent: Feb. 3, 2009

(54) SPOT CLEANER

(75) Inventors: Wayne C. Sigl, Neenah, WI (US); Amanda O'Connor, Appleton, WI (US); James McManus, Hortonville, WI (US); Diane Luxhoj, Appleton, WI (US); Linda L. Bartelt, Waupaca, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 772 days.

(21) Appl. No.: 10/955,332

(22) Filed: Sep. 30, 2004

(65) Prior Publication Data

US 2006/0064830 A1 Mar. 30, 2006

(51) Int. Cl.
*A47L 13/17* (2006.01)
*A47L 13/19* (2006.01)
*A47L 25/00* (2006.01)

(52) U.S. Cl. ..... 15/104.94; 15/227

(58) Field of Classification Search ..... 15/104.94, 15/227

See application file for complete search history.

(56) References Cited

U.S. PATENT DOCUMENTS

| | | | | |
|---|---|---|---|---|
| 532,462 | A | 1/1895 | Humphrey | |
| 671,296 | A | 4/1901 | Rowand | |
| 981,192 | A | 1/1911 | Hollingshead | |
| 1,139,283 | A | 5/1915 | Hepner | |
| 1,343,466 | A | 6/1920 | Mork | |
| 1,379,976 | A | 5/1921 | Gutmann | |
| 1,569,854 | A | 1/1926 | Doerr | |
| 1,940,728 | A | 12/1933 | O'Connor | 15/227 |
| 1,941,320 | A | 12/1933 | Pamplin | 15/227 |
| 1,999,753 | A | 4/1935 | Diemer | 15/227 |
| 2,044,428 | A | 6/1936 | Gilmer | 15/227 |

(Continued)

FOREIGN PATENT DOCUMENTS

EP 0032793 A2 7/1981

(Continued)

OTHER PUBLICATIONS

Chaignon, V., "Copper Bioavailability and Exractability as Related to Chemical Properties of Contaminated Soils From a Vine-Growing Area", *Envrionmental Pollution 123*, (2003),229-238.

(Continued)

*Primary Examiner*—David B Thomas
(74) *Attorney, Agent, or Firm*—Armstrong Teasdale LLP

(57) ABSTRACT

The present invention relates to a spot cleaner that includes a first absorbent pad and a second absorbent pad. The first absorbent pad includes a cleaner. The spot cleaner further includes a moisture proof barrier that is between the first absorbent pad and the second absorbent pad. The moisture proof barrier encloses the first absorbent pad to keep the cleaner inside the moisture proof barrier. In some embodiments, the moisture proof barrier has a first layer that is attached to the first absorbent pad and a second layer that is attached to the second absorbent pad. The first and second layers of the moisture proof barrier may be separable to allow a hand to be inserted between the first and second layers so that the hand is able to manipulate the spot cleaner without any portion of the spot or cleaner contacting the hand.

24 Claims, 10 Drawing Sheets

U.S. PATENT DOCUMENTS

| | | | | |
|---|---|---|---|---|
| 2,103,455 | A | 12/1937 | Greenwald | 15/227 |
| 2,210,754 | A | 8/1940 | Frank | 15/227 |
| 2,621,784 | A | 12/1952 | Boytham | 206/46 |
| 2,795,806 | A | 6/1957 | Suttles | 15/131 |
| 3,056,154 | A | 10/1962 | Neal | 15/104 |
| 3,329,985 | A | 7/1967 | Glowacki, Jr. | 15/104 |
| 3,581,447 | A | 6/1971 | Falivene | 51/400 |
| 3,608,708 | A | 9/1971 | Storandt | 206/46 R |
| 3,638,789 | A | 2/1972 | Tuszewski | 206/63.2 R |
| 3,647,305 | A | 3/1972 | Baker | 401/7 |
| 3,686,125 | A * | 8/1972 | Miller | 8/142 |
| 3,711,889 | A | 1/1973 | Jennings | 15/227 |
| 3,777,328 | A | 12/1973 | Kaplan | 15/104.94 |
| 3,778,172 | A | 12/1973 | Myren | 401/7 |
| 3,793,121 | A | 2/1974 | Eberly, Jr. | 152/522 |
| 3,860,705 | A | 1/1975 | Rubino et al. | |
| 3,877,922 | A | 4/1975 | Grier et al. | |
| 3,885,249 | A | 5/1975 | De Brabander | 2/161 R |
| 3,887,940 | A | 6/1975 | Mangold et al. | |
| 3,912,490 | A | 10/1975 | Boghosian | |
| 3,954,873 | A | 5/1976 | Gipson | |
| 3,982,298 | A | 9/1976 | Ota | 15/106 |
| 4,008,351 | A | 2/1977 | Inoue et al. | |
| 4,055,702 | A | 10/1977 | Guthrie et al. | |
| 4,062,859 | A | 12/1977 | Weiler et al. | |
| 4,071,921 | A | 2/1978 | Jury | 15/227 |
| 4,154,542 | A | 5/1979 | Rasmason | 401/7 |
| 4,159,883 | A | 7/1979 | Mizell | |
| 4,170,704 | A | 10/1979 | Brandman et al. | |
| 4,176,100 | A | 11/1979 | Rider | |
| 4,184,888 | A | 1/1980 | Zoumut | |
| 4,263,677 | A | 4/1981 | Menser | 2/158 |
| 4,323,656 | A | 4/1982 | Strickman et al. | 521/109 |
| 4,339,581 | A | 7/1982 | Totten et al. | |
| 4,347,931 | A | 9/1982 | Ginger et al. | 206/438 |
| 4,349,288 | A | 9/1982 | Bond | 401/7 |
| 4,372,867 | A | 2/1983 | Taragos | 252/91 |
| 4,391,813 | A | 7/1983 | Szkolnik | |
| D273,336 | S | 4/1984 | Zutler | D28/63 |
| D277,050 | S | 1/1985 | Bruseloff | D2/361 |
| 4,510,640 | A | 4/1985 | Omori | 15/104 A |
| 4,523,348 | A | 6/1985 | Petrie | 15/227 |
| 4,552,885 | A | 11/1985 | Gabriele et al. | |
| 4,593,427 | A | 6/1986 | Ortolivo | 15/227 |
| 4,596,481 | A | 6/1986 | Tanaka | 401/132 |
| 4,596,864 | A | 6/1986 | Trotz et al. | |
| 4,632,881 | A | 12/1986 | Trotz et al. | |
| 4,670,930 | A | 6/1987 | Lu | 15/118 |
| D290,777 | S | 7/1987 | Lee | D32/40 |
| 4,677,697 | A | 7/1987 | Hayes | 2/159 |
| 4,788,733 | A | 12/1988 | Lerner | 15/104.94 |
| 4,797,967 | A | 1/1989 | Lengers | 15/227 |
| 4,820,558 | A | 4/1989 | Sundberg | 428/34.3 |
| 4,843,652 | A | 7/1989 | Kuwahara | 2/167 |
| D303,725 | S | 9/1989 | Rojko | D29/20 |
| 4,893,955 | A | 1/1990 | Zielinski | 401/7 |
| 4,901,851 | A * | 2/1990 | Gerry | 206/223 |
| 4,902,283 | A | 2/1990 | Rojko et al. | 604/290 |
| D307,198 | S | 4/1990 | Rojko | D29/20 |
| D307,199 | S | 4/1990 | Rojko | D18/20 |
| 4,932,095 | A | 6/1990 | Kawase | 15/227 |
| 4,953,250 | A | 9/1990 | Brown | 15/104.94 |
| 4,954,338 | A | 9/1990 | Mattox | |
| 4,959,881 | A | 10/1990 | Murray | 15/227 |
| 4,964,188 | A | 10/1990 | Olson | 15/227 |
| 4,980,943 | A | 1/1991 | Barber | 15/227 |
| 4,986,681 | A | 1/1991 | Oliver | 401/7 |
| 4,987,632 | A | 1/1991 | Rowe et al. | 15/104.93 |
| 5,008,969 | A | 4/1991 | Jarrett | 15/227 |
| 5,010,617 | A | 4/1991 | Nelson | 15/227 |
| 5,019,058 | A | 5/1991 | Storandt | 604/290 |
| 5,020,160 | A | 6/1991 | Cano | 2/159 |
| 5,111,934 | A * | 5/1992 | Morin | 206/229 |
| 5,127,127 | A | 7/1992 | Jarosinski | 15/227 |
| 5,134,746 | A | 8/1992 | William | 15/227 |
| 5,142,727 | A | 9/1992 | Koester | 15/230 |
| 5,154,932 | A | 10/1992 | Burba, III et al. | |
| 5,169,251 | A | 12/1992 | Davis | 401/7 |
| 5,208,272 | A | 5/1993 | LeSota | |
| 5,301,806 | A | 4/1994 | Olson | 206/278 |
| 5,373,601 | A | 12/1994 | Miller | 15/118 |
| 5,419,014 | A | 5/1995 | Piantedosi | 15/227 |
| 5,429,920 | A | 7/1995 | Hioki et al. | |
| 5,441,355 | A | 8/1995 | Moore | 401/7 |
| 5,457,843 | A * | 10/1995 | Gelardi et al. | 15/229.12 |
| 5,460,644 | A | 10/1995 | Thomassen | |
| 5,473,789 | A | 12/1995 | Oster | 15/104.94 |
| D365,896 | S | 1/1996 | Zuege | D32/40 |
| 5,507,968 | A | 4/1996 | Palaikis | 252/90 |
| 5,542,566 | A | 8/1996 | Glaug et al. | 221/48 |
| 5,565,265 | A | 10/1996 | Rubin et al. | |
| 5,585,407 | A | 12/1996 | Patel et al. | |
| 5,616,201 | A | 4/1997 | Finch et al. | 156/73.1 |
| 5,636,406 | A | 6/1997 | Strong | 15/227 |
| 5,639,532 | A * | 6/1997 | Wells | 428/95 |
| D381,772 | S | 7/1997 | Williams | D32/40 |
| 5,694,659 | A | 12/1997 | Merrion | 15/214 |
| 5,698,191 | A | 12/1997 | Wiersma et al. | |
| 5,698,212 | A | 12/1997 | Hagiwara | |
| RE35,814 | E | 6/1998 | Olson | 206/278 |
| 5,864,883 | A | 2/1999 | Reo | 2/158 |
| 5,882,731 | A | 3/1999 | Owens | |
| 5,916,742 | A | 6/1999 | Ikari et al. | |
| 5,924,160 | A | 7/1999 | Bradley | 15/227 |
| 5,946,727 | A | 9/1999 | Wright et al. | 2/161.7 |
| 5,956,770 | A | 9/1999 | Dennis | 2/160 |
| 5,979,007 | A | 11/1999 | Soon | 15/227 |
| 5,987,645 | A | 11/1999 | Teaster | 2/159 |
| 5,998,543 | A | 12/1999 | Collins et al. | |
| 6,005,035 | A | 12/1999 | Raynolds et al. | |
| 6,007,264 | A | 12/1999 | Koptis | 401/132 |
| D418,954 | S | 1/2000 | Ferdenzi | D32/35 |
| 6,018,837 | A | 2/2000 | Andreu | 15/118 |
| 6,024,970 | A | 2/2000 | Woodard | 424/402 |
| 6,052,856 | A * | 4/2000 | DeMoya et al. | 15/227 |
| 6,085,367 | A | 7/2000 | Guiste | |
| 6,098,234 | A | 8/2000 | Jackson, Jr. | 15/118 |
| 6,115,873 | A | 9/2000 | Dunkley | 15/227 |
| 6,145,155 | A | 11/2000 | James et al. | 15/227 |
| 6,178,554 | B1 | 1/2001 | Pake et al. | 2/20 |
| 6,192,543 | B1 | 2/2001 | Lee | 15/118 |
| 6,206,863 | B1 | 3/2001 | Skewes et al. | 604/290 |
| 6,241,580 | B1 | 6/2001 | Fisher | 451/28 |
| 6,255,366 | B1 | 7/2001 | Adams et al. | |
| D447,298 | S | 8/2001 | Swoboda | D32/40 |
| 6,275,995 | B1 | 8/2001 | Le Gette et al. | 2/160 |
| D449,725 | S | 10/2001 | Brown | D32/40 |
| 6,297,328 | B1 | 10/2001 | Collins et al. | |
| 6,323,268 | B1 | 11/2001 | Fisher et al. | |
| D453,981 | S | 2/2002 | Brown | D32/40 |
| 6,348,092 | B1 | 2/2002 | Atkinson | |
| D454,237 | S | 3/2002 | Brown | D32/40 |
| 6,387,300 | B1 | 5/2002 | Bosserman | |
| 6,391,061 | B1 | 5/2002 | Hortel et al. | 8/137.5 |
| 6,403,163 | B1 | 6/2002 | Fisher et al. | |
| 6,433,244 | B1 | 8/2002 | Roe et al. | 604/361 |
| 6,508,602 | B1 | 1/2003 | Gruenbacher et al. | 401/7 |
| 6,516,469 | B1 | 2/2003 | Schaetzel | 2/16 |
| D471,333 | S | 3/2003 | Brown | D32/40 |
| 6,530,108 | B1 | 3/2003 | Brown et al. | 15/227 |
| 6,562,931 | B1 | 5/2003 | Knepper | |
| 6,588,961 | B2 | 7/2003 | Lafosse-Marin et al. | 401/134 |
| 6,607,739 | B1 * | 8/2003 | Wallo | 424/404 |
| 6,647,549 | B2 | 11/2003 | McDevitt et al. | 2/21 |

| | | | | |
|---|---|---|---|---|
| 6,687,942 | B1 | 2/2004 | Pember | 15/227 |
| 6,716,487 | B1 | 4/2004 | Song | |
| 6,811,338 | B1 * | 11/2004 | Manske, Jr. et al. | 401/7 |
| 7,307,055 | B2 * | 12/2007 | Cook et al. | 510/438 |
| 2002/0026679 | A1 | 3/2002 | Widlund | 15/227 |
| 2002/0124335 | A1 | 9/2002 | Franko, Sr. | 15/104.002 |
| 2002/0170133 | A1 | 11/2002 | McDevitt et al. | 15/167.1 |
| 2002/0189025 | A1 | 12/2002 | Hortel et al. | 8/137.5 |
| 2003/0014824 | A1 | 1/2003 | Farmer | 15/118 |
| 2003/0109411 | A1 | 6/2003 | Kilkenny et al. | 510/438 |
| 2003/0120180 | A1 | 6/2003 | Kaylor et al. | 600/584 |
| 2003/0191204 | A1 | 10/2003 | Hermann et al. | 521/82 |
| 2003/0196290 | A1 | 10/2003 | McKenzie | 15/227 |
| 2003/0216273 | A1 | 11/2003 | Mitra et al. | 510/295 |
| 2003/0217425 | A1 | 11/2003 | Datta et al. | 15/227 |

FOREIGN PATENT DOCUMENTS

| | | | |
|---|---|---|---|
| EP | 0068516 | A1 | 1/1983 |
| EP | 0154070 | A1 | 9/1985 |
| EP | 0338034 | B1 | 10/1989 |
| EP | 0365998 | A2 | 5/1990 |
| EP | 0367744 | B1 | 5/1990 |
| EP | 0409802 | A2 | 1/1991 |
| EP | 0422086 | B1 | 4/1991 |
| EP | 0546426 | B1 | 6/1993 |
| EP | 0635237 | A1 | 1/1995 |
| EP | 0638277 | A1 | 2/1995 |
| EP | 0721760 | B1 | 7/1996 |
| EP | 0753280 | B1 | 1/1997 |
| EP | 0788327 | B1 | 8/1997 |
| EP | 0820705 | A2 | 1/1998 |
| EP | 1062903 | A1 | 12/2000 |
| EP | 1099402 | A2 | 5/2001 |
| EP | 1212972 | A2 | 6/2002 |
| EP | 1316413 | A1 | 6/2003 |
| GB | 237121 | | 7/1925 |
| GB | 2074437 | | 11/1981 |
| GB | 2252235 | A | 8/1992 |
| GB | 2322287 | A | 8/1998 |
| GB | 2351981 | A | 1/2001 |
| GB | 2353465 | A | 2/2001 |
| JP | 02265521 | A | 10/1990 |
| JP | 07000227 | A | 1/1995 |
| JP | 7284467 | | 10/1995 |
| JP | 07303588 | A | 11/1995 |
| JP | 07327901 | A | 12/1995 |
| JP | 07327902 | A | 12/1995 |
| JP | 07327903 | A | 12/1995 |
| JP | 08000521 | A | 1/1996 |
| JP | 08024190 | A | 1/1996 |
| JP | 08238204 | A | 9/1996 |
| JP | 08289866 | A | 11/1996 |
| JP | 08295207 | A | 11/1996 |
| JP | 09122057 | A | 5/1997 |
| JP | 09140648 | A | 6/1997 |
| JP | 09313419 | A | 12/1997 |
| JP | 10014840 | A | 1/1998 |
| JP | 10117983 | A | 5/1998 |
| JP | 10137168 | A | 5/1998 |
| JP | 10-222068 | | 8/1998 |
| JP | 10248781 | A | 9/1998 |
| JP | 10262885 | A | 10/1998 |
| JP | 11000297 | A | 1/1999 |
| JP | 11197079 | A | 7/1999 |
| JP | 2001-29383 | | 2/2001 |
| JP | 2001292943 | A | 10/2001 |
| JP | 2002159427 | A | 6/2002 |
| JP | 2003000510 | A | 1/2003 |
| JP | 2003023916 | A | 1/2003 |
| JP | 2003038405 | A | 2/2003 |
| JP | 2003052599 | A | 2/2003 |
| JP | 2003052600 | A | 2/2003 |
| JP | 2003070709 | A | 3/2003 |
| JP | 2003116763 | A | 4/2003 |
| JP | 2003-137756 | | 5/2003 |
| WO | WO-9007297 | A1 | 7/1990 |
| WO | WO-9638061 | A1 | 12/1996 |
| WO | WO-0026329 | A1 | 5/2000 |
| WO | WO-0040372 | A1 | 7/2000 |
| WO | WO-02067758 | A1 | 9/2002 |
| WO | WO-03000106 | A1 | 1/2003 |
| WO | WO-03043481 | A2 | 5/2003 |
| WO | WO-03045135 | A2 | 6/2003 |
| WO | WO-03082070 | A1 | 10/2003 |

OTHER PUBLICATIONS

Itoh, Hiroyuki, "Synthesis and Fungicidal Activities of Silicon-Containing Derivatives of 2-Aryl-3-(1*H*-1,2,4-triazol-1-yl) propanenitriles", *Chem. Pharm. Bull.*, 49, (2001),909-911.

Karasuda, Shuji, "Plant Chitinase as a Possible Biocontrol Agent for Use Instead of Chemical Fungicides", *Biosci. Biotechnol. Biochem.*, vol. 67, No. 1, (2003),221-224.

Oros, G., "Antimicrobial Activity of *o*-carboranylalanine", *Amino Acids*, 17, (1999),357-368.

Singh, U. P., "Antifungal Activity of Venenatine, an Indole Alkaloid Isolated from *Alstonia venenata", Folia Microbiol*, vol. 45, No. 2, (2000),173-176.

Wojdyla, Adam T., "Grapefruit Extract Activity in the Control of Rose Powdery Mildew and Black Spot", *Med. Fac. Landbouww. Univ. Gent.*, 66/2a, (2001),167-177.

Wojdyla, Adam T., "Oils Activity in the control of Rose Powdery Mildew", *Proceeding 54th International Symposium on Crop Protection*, vol. 67, No. 2, (2002),369-376.

* cited by examiner

SPOT CLEANER

FIELD

The present invention relates to a spot cleaner, and more particularly to a spot cleaner that uses wet and dry materials to clean spots.

BACKGROUND

There are a variety of products and processes that are used to clean carpet and/or upholstery. Some of these products are specifically designed to clean spots on localized areas of carpeting or upholstery.

One drawback with using some spot cleaning products is that there is a risk of damaging the carpet or upholstery where the spot is located. As an example, when brisk brushing is used in combination with a cleaner to clean a spot, the resulting shear forces that are generated on the carpet or upholstery often harm the underlying carpet or upholstery.

Another drawback with some spot cleaning products is that the products may leave unsightly residue on the carpet or upholstery. In addition, any dyes that are part the spot-cleaned area may become discolored or partly removed.

There is a need for a spot cleaner that utilizes a cleaner in combination with mild mechanical agitation to loosen and remove the spot from a localized area on carpet or upholstery. The spot cleaner should be able to clean spots from carpet or upholstery without abrading or otherwise damaging the carpet or upholstery.

SUMMARY OF THE INVENTION

The present invention relates to spot cleaner that may be used to remove a spot from a localized area of a substrate (e.g., carpeting or upholstery). The spot cleaner utilizes a cleaner that is effective at dissolving and/or suspending spots in combination with mild mechanical agitation to clean spots without abrading or damaging the underlying substrate.

In one example embodiment, the spot cleaner includes a first absorbent pad and a second absorbent pad. The first absorbent pad includes a cleaner. The spot cleaner further includes a moisture proof barrier that is between the first absorbent pad and the second absorbent pad. The moisture proof barrier encloses the first absorbent pad to keep the cleaner inside the moisture proof barrier. In some embodiments, the moisture proof barrier may serve as packaging for the first absorbent pad and the cleaner before the spot cleaner is used to clean a spot.

In another example embodiment, the spot cleaner includes a first absorbent pad and a second absorbent pad. The first absorbent pad includes a cleaner. The spot cleaner further includes a moisture proof barrier that has a first layer attached to the first absorbent pad and a second layer attached to the second absorbent pad. The first and second layers are between the first absorbent pad and the second absorbent pad. In addition, the moisture proof barrier encloses the first absorbent pad to keep the cleaner inside the moisture proof barrier. In some embodiments, the first and second layers of the moisture proof barrier may be separable to allow a hand to be inserted between the first and second layers so that the hand is able to manipulate the spot cleaner without any portion of the spot or cleaner engaging the hand.

The present invention also relates to a method of cleaning a spot from a localized area. The method includes positioning a spot cleaner near the localized area. The spot cleaner includes a first absorbent pad and a second absorbent pad. The first absorbent pad includes a cleaner. The spot cleaner further includes a second absorbent pad and a moisture proof barrier that is between the first absorbent pad and the second absorbent pad. The moisture proof barrier encloses the first absorbent pad.

The method further includes manipulating the moisture proof barrier to expose the first absorbent pad and holding the first absorbent pad against the localized area such that the cleaner disengages the spot from the localized area. The method further includes absorbing at least some of the cleaner and at least some of the disengaged spot from the localized area using the second absorbent pad.

The method may further include covering the first absorbent pad with the moisture proof barrier after the cleaner disengages the spot from the localized area. In some embodiments, the moisture proof barrier includes a first layer that is attached to the first absorbent pad and a second layer that is attached to the second absorbent pad such that the method further includes inserting a hand between the first layer and the second layer and then pressing the first or second absorbent pad against the spot using the hand.

The purposes and features of the present invention will be set forth in the description that follows. Additional features of the invention will be realized and attained by the product and processes particularly pointed out in the written description and claims hereof, as well as from the appended drawings.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the invention.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. Like parts depicted in the drawings are referred to by the same reference numerals.

DETAILED DESCRIPTION OF THE INVENTION

In the following detailed description, reference is made to the accompanying drawings, which show specific embodiments in which the invention may be practiced. These embodiments are described in sufficient detail to enable those skilled in the art to practice the invention. It is to be understood that other embodiments may be utilized and structural changes made, such that the following detailed description is not to be taken in a limiting sense.

The present invention relates to a spot cleaner that may be used to aid individuals in cleaning spots from a substrate (e.g., carpet or upholstery). The spot cleaner is applied to a substrate so that a cleaner engages an area on the substrate where the spot located. The cleaner may be distributed over the area where the spot is located by mildly manipulating the spot cleaner over the area.

Combining the cleaner with mild mechanical agitation serves to physically dislodge and/or dissolve any spots. The cleaner and the particulate form a solution that is absorbed (e.g., by capillary action) into a pad and transported away from the substrate.

Figure 1:
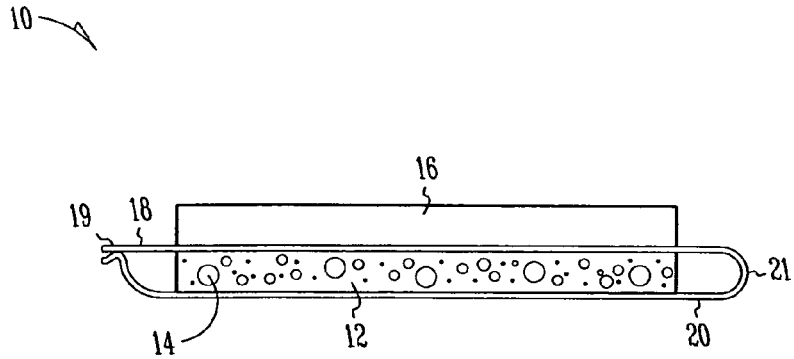
FIG. 1 is a section view of an example spot cleaner.

FIG. 1 shows an example spot cleaner 10 of the present invention. The spot cleaner 10 includes a first absorbent pad 12 and a second absorbent pad 16. The first absorbent pad 16 includes a cleaner 14. The spot cleaner 10 further includes a moisture proof barrier 18 that is between the first absorbent pad 12 and the second absorbent pad 16. The moisture proof barrier 18 encloses the first absorbent pad 12 such that the cleaner 14 is maintained within the moisture proof barrier 18.

In the illustrated example embodiment, the moisture proof barrier 18 includes a first section 19, a second section 20 and a fold 21 that separates the first section 19 from the second section 20. The first section 19 of the moisture proof barrier 18 is between the first and second absorbent pads 12, 16.

Figure 2:
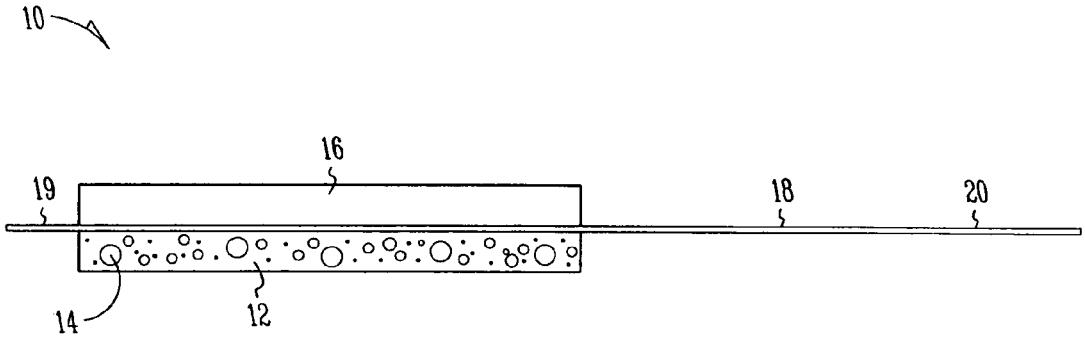
FIG. 2 is a section view of the spot cleaner shown in FIG. 1 with a moisture proof barrier of the spot cleaner opened to expose a first absorbent pad that includes a cleaner.

FIG. 2 shows the spot cleaner 10 after the moisture proof barrier 18 has been opened to expose the first absorbent pad 12 and the cleaner 14. In some embodiments, the moisture proof barrier 18 may be opened by peeling one portion (e.g., second section 20) of the moisture proof barrier 18 from another portion (e.g., first section 19) of the moisture proof barrier 18.

It should be noted that moisture proof barrier 18 may be a variety of materials. As an example, moisture proof barrier 18 may be a polymeric film.

In other embodiments, the second section 20 may be removable from the spot cleaner 10 to expose the first absorbent pad 12. As an example, the moisture proof barrier 18 may include a weakened (e.g., perforated) section (not shown) such that opening the moisture proof barrier 18 may include tearing the weakened section of the moisture proof barrier 18 to remove a portion (e.g., second section 20) of the moisture proof barrier 18.

Cleaner 14 may be any material that is known to clean spots and may be in any form (e.g., liquid, solid, powder, granules). In addition, cleaner 14 may be a combination of materials. As an example, cleaner 14 may be a liquid solution that includes surfactants which provide detersive cleaning benefits and organic solvents which serve to loosen the bonds between particles.

In some embodiments, cleaner 14 may be water-based as opposed to solvent-based in order to avoid flammability and odor problems. A water-based cleaner 14 may also lessen the likelihood of the cleaner 14 damaging the substrate (e.g., carpet or upholstery) where the spot is located.

In addition, the cleaner 14 may be fairly dilute so that it does not leave a ring on the substrate. As an example, the cleaner 14 may be a 2% solution of a detergent/surfactant in water such that the cleaner 14 is gentle on carpets and/or fabrics.

In some embodiments, the cleaner 14 may be a non rinse composition that leaves no residue behind. The cleaner 14 may also include a fragrance and/or odor reducing agent.

The first and second absorbent pads 12, 16 may be made of the same material or different materials. In some embodiments, the first and second absorbent pads 12, 16 have surfaces with high abrasion resistance such that they do not leave lint on a substrate as a user rubs the pads 12, 16 against the substrate. In addition, the first and second absorbent pads 12, 16 may be textured to facilitate cleaning certain types of spots.

The first absorbent pad 12 may be a lofty material with large capillary structure so that first absorbent pad 12 readily releases the cleaner 14. In addition, the second absorbent pad 16 may have a small capillary structure so that the second absorbent pad 16 readily absorbs the cleaner 14 and any released spot materials from the carpet or upholstery. The second absorbent pad 16 may have enough absorbent capacity to hold (i) the amount of cleaner 14 that gets released during the cleaning operation; and (ii) any material that was associated with the original spot.

An example material that may be used for the first absorbent pad 12 is a 50% polymer-50% fiber coform material. An example material that may be used for the second absorbent pad 16 is a combined wettable spunbond/meltblown material with the spunbond material facing outward so that the spunbound material engages the spot first.

In some embodiments, the second absorbent pad 16 may be a nonwoven material with sufficient capacity to absorb an amount of urine that a large pet (e.g., a dog) might void. The second absorbent pad 16 may also be used to pick up solid or semi solid objects (e.g., fur balls and/or feces). In addition, the second absorbent may be a super absorbent material (e.g., a commercially available acrylic acid-based hydrogel material).

It should be noted that the spot cleaner 10 may be manufactured in multiple sizes. The size and type of spot cleaner that is chosen to clean a spot will depend in part on the size and type of spot that is to be cleaned and the type of substrate where the spot is located.

Figure 3:
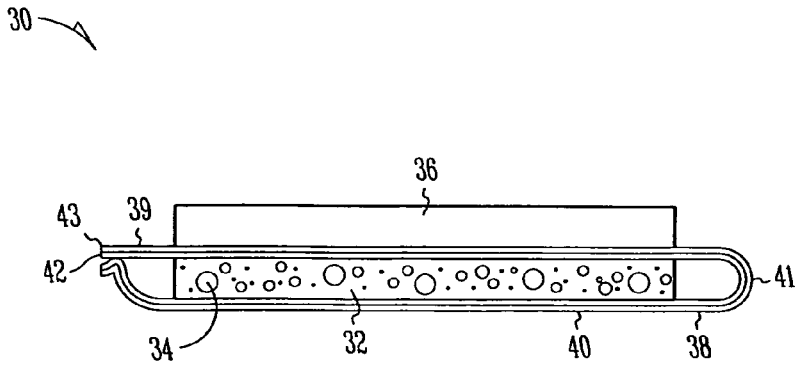
FIG. 3 is a section view of another example spot cleaner.

FIG. 3 shows another example spot cleaner 30 of the present invention. The spot cleaner 30 includes a first absorbent pad 32 and a second absorbent pad 36. The first absorbent pad 32 includes a cleaner 34. The spot cleaner 30 further includes a moisture proof barrier 38 that is between the first absorbent pad 32 and the second absorbent pad 36. The moisture proof barrier 38 encloses the first absorbent pad 32 such that the cleaner 34 is maintained within the moisture proof barrier 38.

In the illustrated example embodiment, the moisture proof barrier 38 includes a first section 39, a second section 40 and a fold 41 that separates the first section 39 from the second section 40. The first section 39 of the moisture proof barrier 38 is between the first and second absorbent pads 32, 36.

FIG. 3 shows an example embodiment of the spot cleaner 30 where the moisture proof barrier 38 includes a first layer 42 that is attached to the first absorbent pad 32 and a second layer 43 that is attached to the second absorbent pad 36. The first and second layers 42, 43 are between the first absorbent pad 32 and the second absorbent pad 36.

Figure 4:
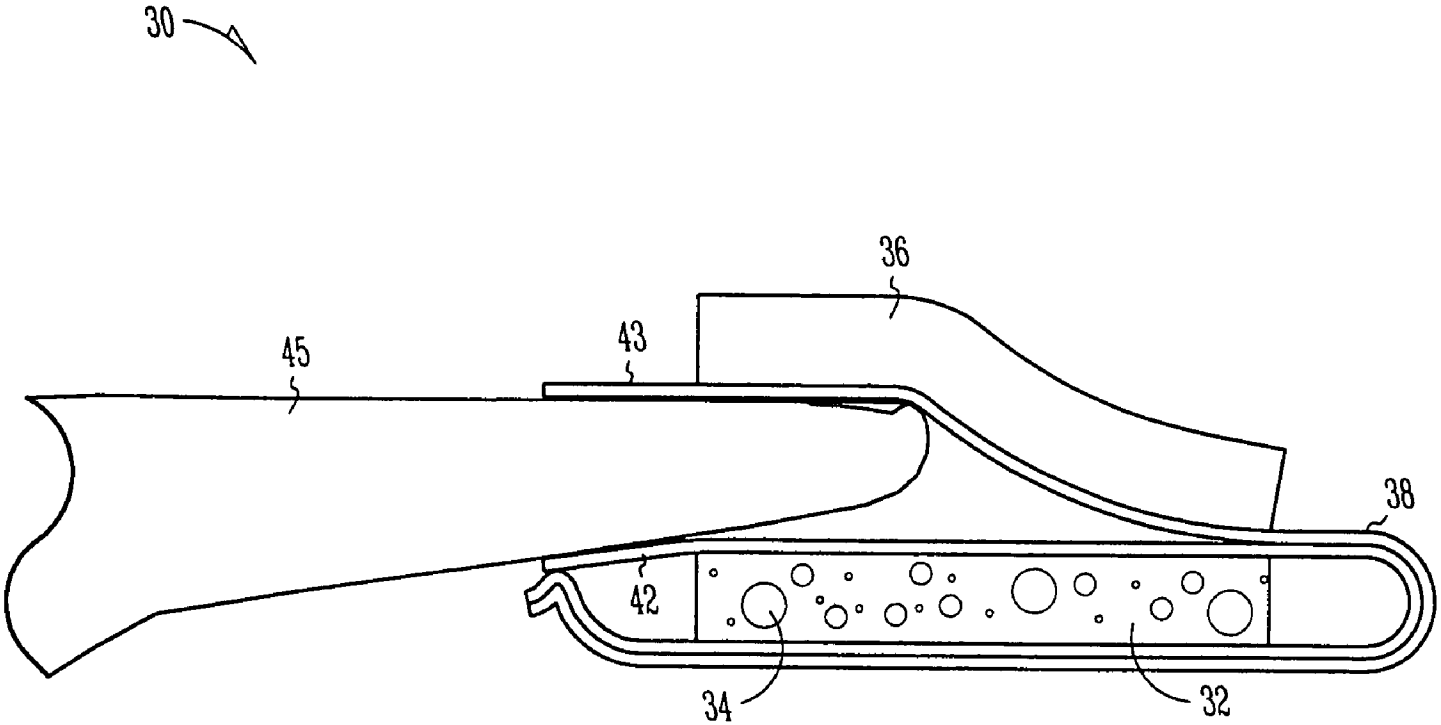
FIG. 4 is a section view of the spot cleaner shown in FIG. 3 with a hand inserted into the spot cleaner.

As shown in FIG. 4, the first and second layers 42, 43 form a barrier that prevents any of the spot from contacting a user's hand 45 such that the process of cleaning up a spot is made more hygienic. The first and second layers 42, 43 may also keep any of the cleaner 34 from contacting the hand 45. Preventing the cleaner and/or spot from contacting the hand 45 may be especially beneficial if the spot and/or cleaner are harmful to human skin.

In some embodiments, the first and second layers 42, 43 may be sized and joined together such that a user is able to turn the moisture proof barrier 38 inside out. Turning the moisture proof barrier 38 inside out to store the cleaner 34 and the spot inside the moisture proof barrier facilitates disposing of the spot cleaner 30 under hygienic conditions.

Figure 5:
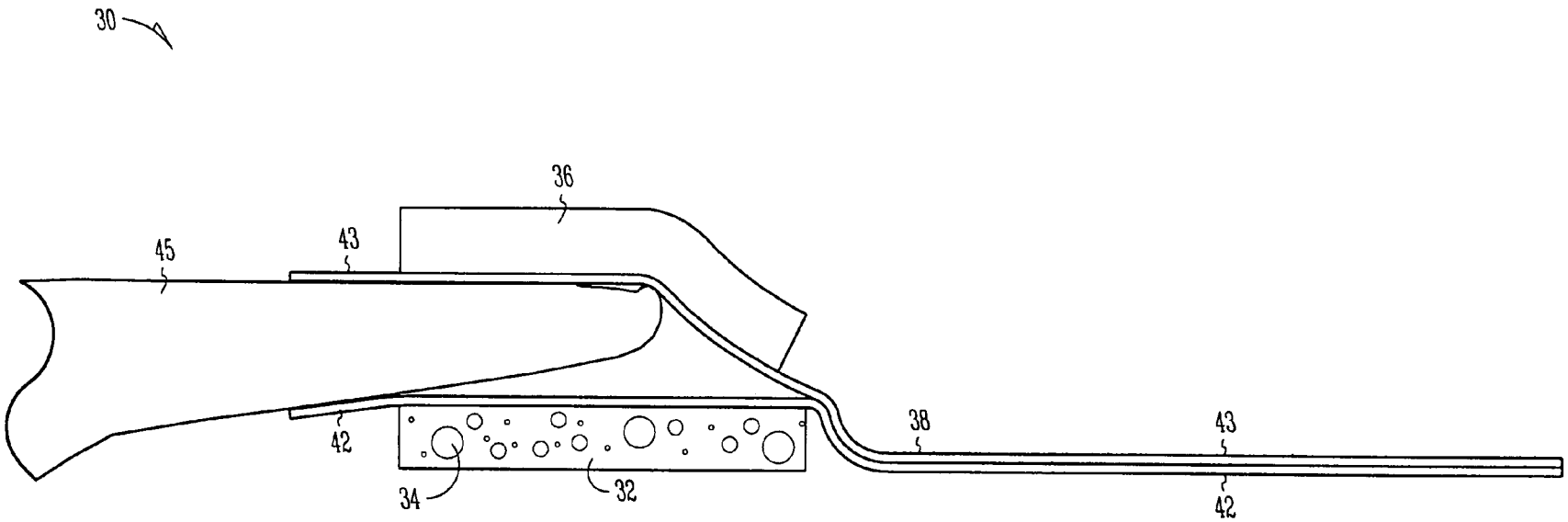
FIG. 5 is a section view of the spot cleaner shown in FIG. 3 with a moisture proof barrier of the spot cleaner opened to expose a first absorbent pad that includes a cleaner and a hand inserted into the spot cleaner.

FIG. 5 shows the spot cleaner 30 after the moisture proof barrier 38 has been opened to expose the first absorbent pad 32 and cleaner 34. As discussed above with regard to spot cleaner 10, the moisture proof barrier 38 may be opened in a variety of ways, including (i) peeling one portion of the moisture proof barrier 38 from another portion of the moisture proof barrier 38; or (ii) tearing a weakened (e.g., perforated) section (not shown) of the moisture proof barrier 38 to remove a portion of the moisture proof barrier 38. It should be noted that cleaner 34 may be similar to any of the cleaners 14 described above with regard to spot cleaner 10.

Figure 6:
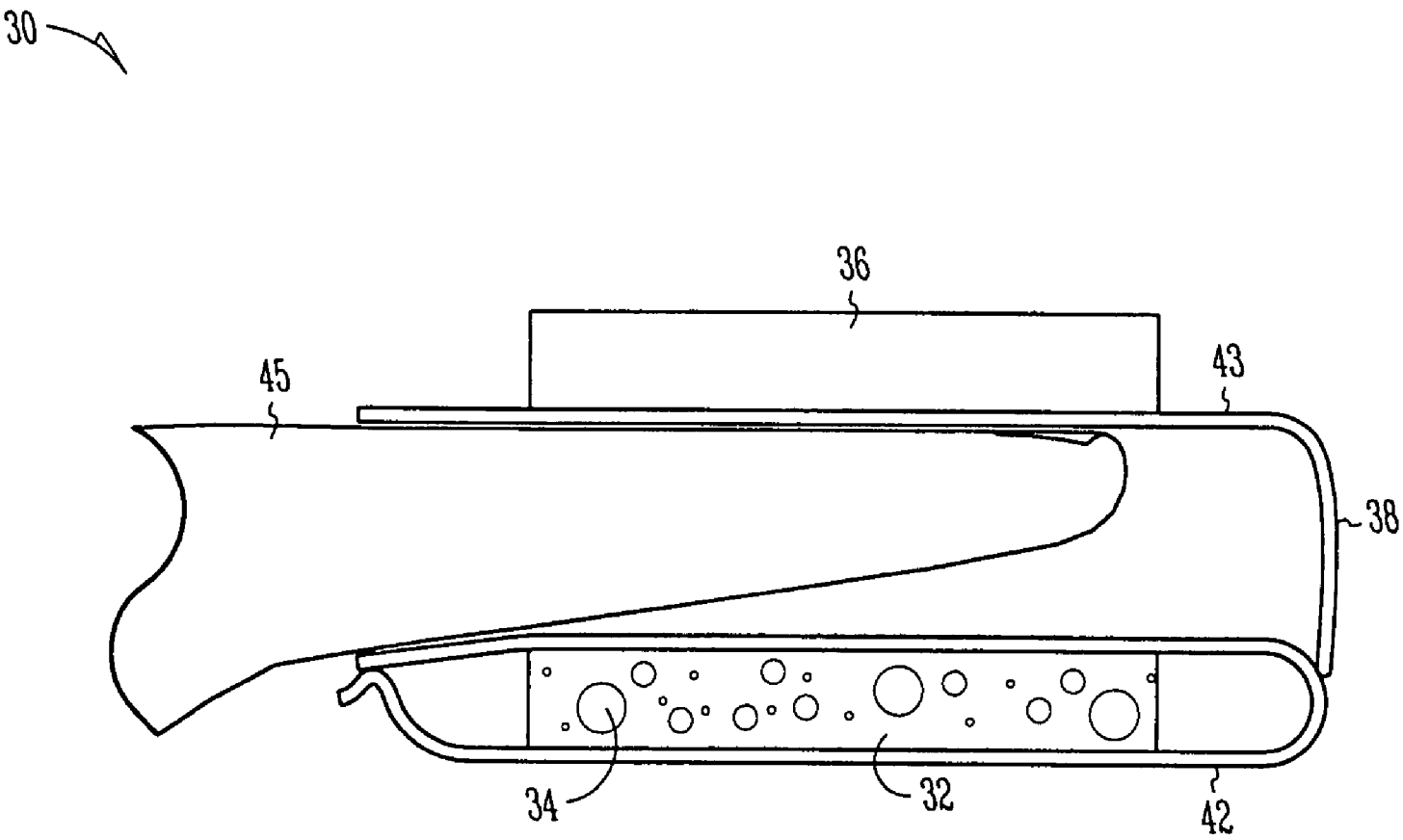
FIG. 6 is a section view illustrating another example embodiment of the spot cleaner shown in FIG. 4 with a hand inserted into the spot cleaner.
Figure 7:
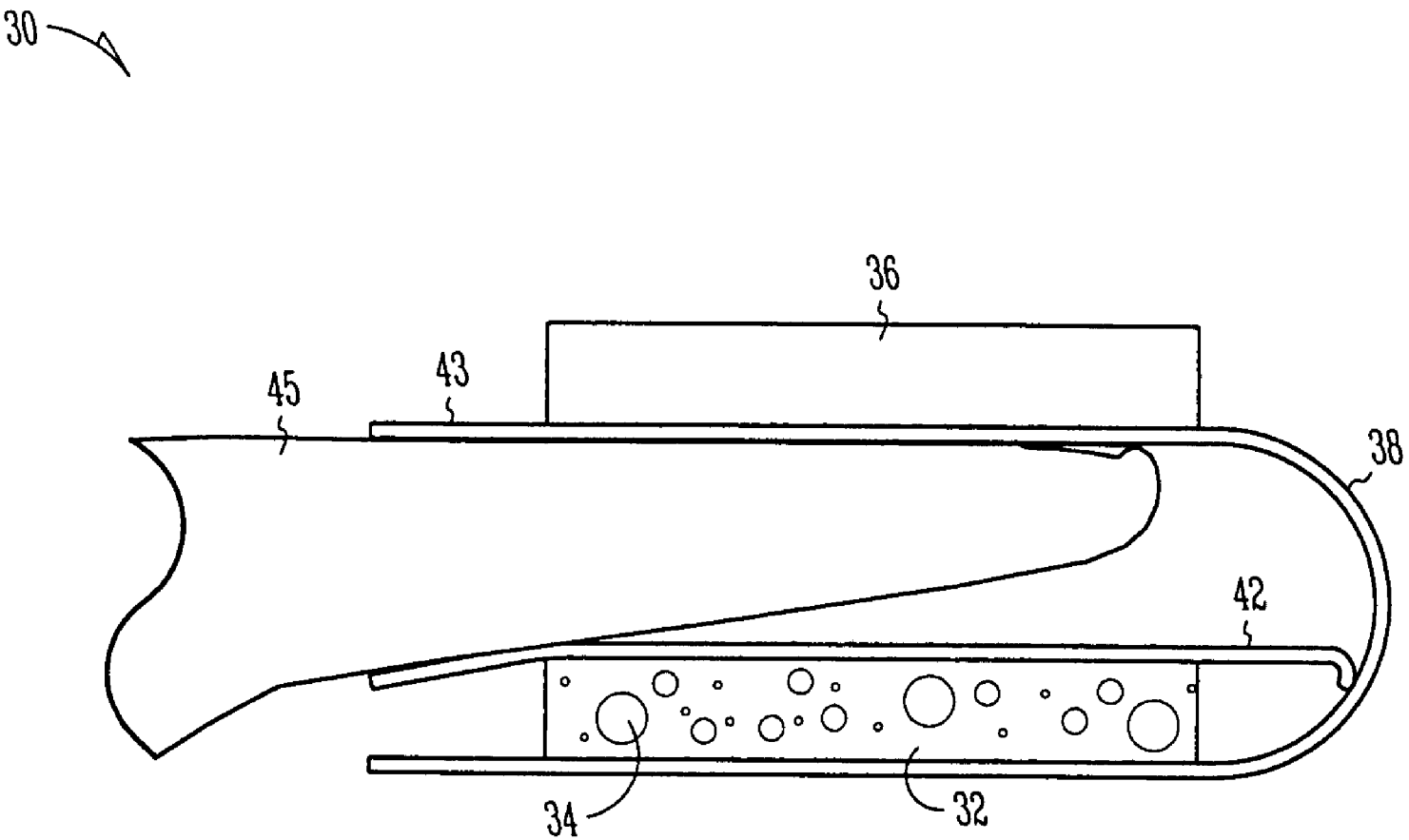
FIG. 7 is a section view illustrating still another example embodiment of the spot cleaner shown in FIG. 4 with a hand inserted into the spot cleaner.
Figure 8:
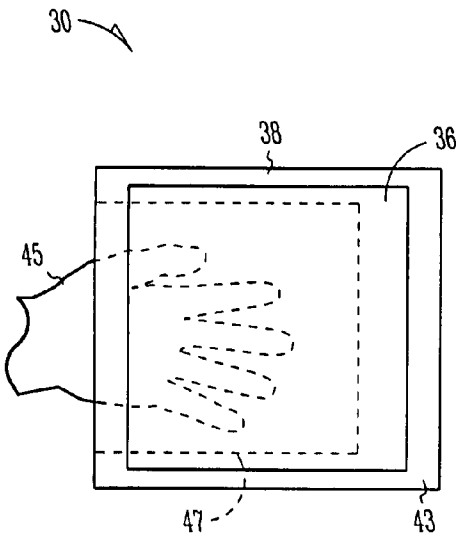
FIG. 8 is a top view illustrating an example embodiment of the spot cleaner shown in FIG. 4 with a hand inserted into the spot cleaner.

There are some embodiments of spot cleaner 30 where only the first layer 42 encloses the first absorbent pad 32 (FIG. 6), and other embodiments where only the second layer 43 encloses the first absorbent pad 32 (FIG. 7). The number, type and shape of the layers that are used in the moisture proof barrier 38 will depend in part on the application where the spot cleaner will be used. FIG. 8 shows an example embodiment where the first and second layers 42, 43 are joined together to form a rectangular opening 47 that is adapted to receive hand 45.

Figure 10:
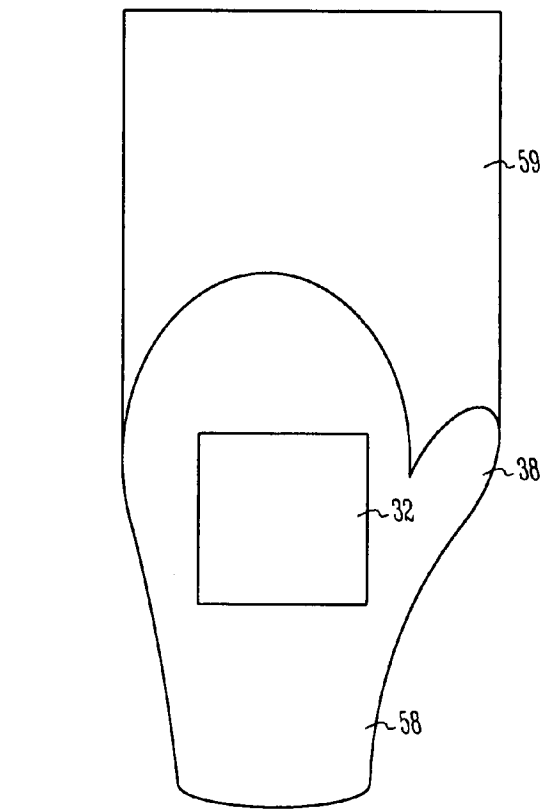
FIG. 10 is a top view of the spot cleaner shown in FIG. 9 where the folding section has been manipulated to expose a first absorbent pad that includes a cleaner.
Figure 9:
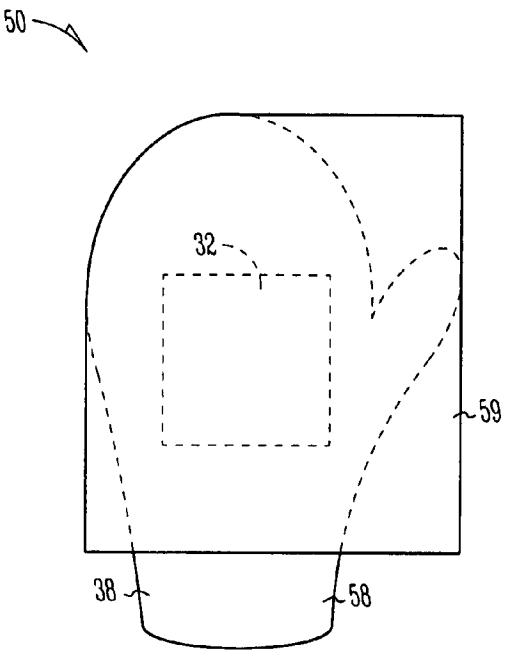
FIG. 9 is a top view of an example spot cleaner that includes a mitt section and a folding section.

FIGS. 9 and 10 illustrate another example spot cleaner 50. Spot cleaner 50 is similar to spot cleaner 30 in that spot cleaner 50 includes a moisture proof barrier 38 that is between a first absorbent pad 32 and a second absorbent pad 36 (pad 36 not visible in FIGS. 9 and 10). The moisture proof barrier 38 includes first and second layers that are joined together to form a mitt section 58 and a folding section 59. The folding section 59 of the moisture proof barrier 38 is movable from a first position (FIG. 9) where the folding section 59 encloses the first absorbent pad 32 and a second position (FIG. 10) where the folding section 59 is folded back to expose the first absorbent pad 32. A hand (not shown) may be inserted into the mitt section 58 when the spot cleaner 50 is used to clean a spot.

Figure 11:
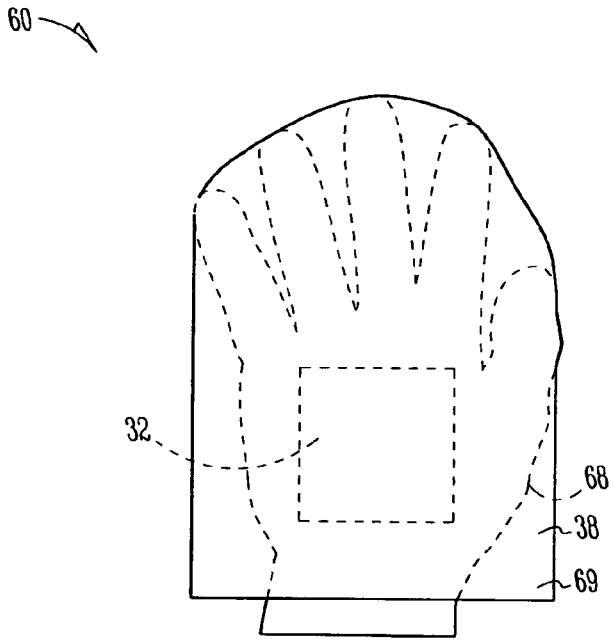
FIG. 11 is a top view of an example spot cleaner that includes a glove section and a folding section.
Figure 12:
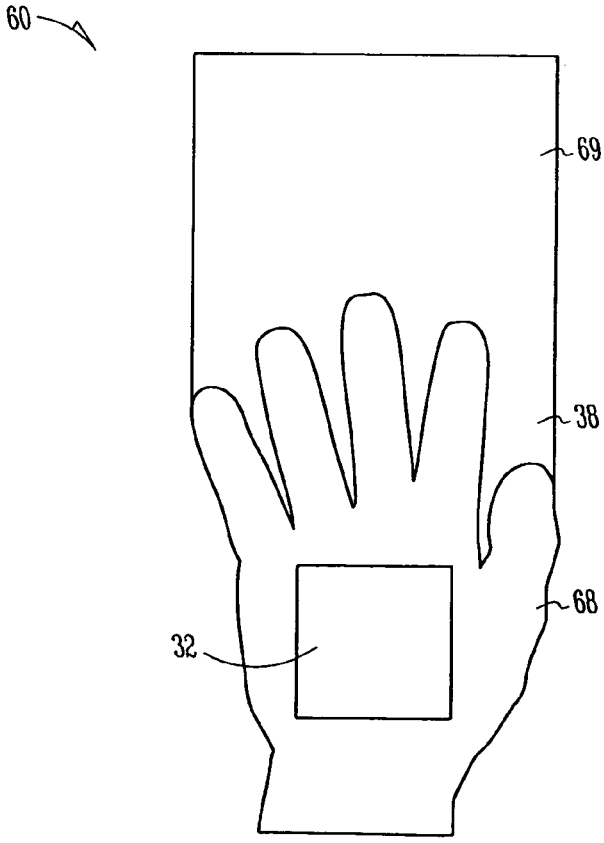
FIG. 12 is a top view of the spot cleaner shown in FIG. 11 where the folding section has been manipulated to expose a first absorbent pad that includes a cleaner.

FIGS. 11 and 12 illustrate another example spot cleaner 60. Spot cleaner 60 is similar to spot cleaner 30 in that spot cleaner 60 includes a moisture proof barrier 38 that is between a first absorbent pad 32 and a second absorbent pad 36 (pad 36 not visible in FIGS. 11 and 12). The moisture proof barrier 38 includes first and second layers that are joined together to form a glove section 68 and a folding section 69. The folding section 69 of the moisture proof barrier 38 is movable from a first position (FIG. 11) where the folding section 69 encloses the first absorbent pad 32 and a second position (FIG. 12) where the folding section 69 is folded back to expose the first absorbent pad 32. A hand (not shown) may be inserted into the glove section 68 when the spot cleaner 60 is used to clean a spot.

Figure 13:
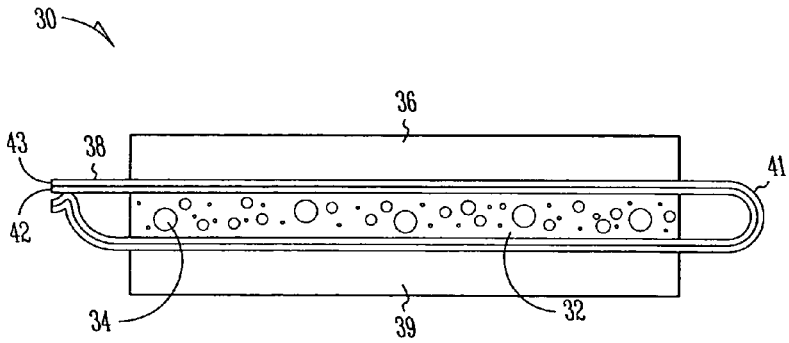
FIG. 13 is a section view illustrating another example embodiment of the spot cleaner shown in FIG. 4.

It should be noted that any of the spot cleaners described herein may further include a third absorbent pad. As an example, FIG. 13 shows that spot cleaner 30 may further include a third absorbent pad 39 such that the moisture proof barrier 38 is between the first absorbent pad 32 and the third absorbent pad 39. In some embodiments, the third absorbent pad 39 may be part of the second absorbent pad 36 where the second absorbent pad extends around the fold 41.

The third absorbent pad 39 may be used to initially engage the spot and absorb at least some portions of the spot. As an example, the third absorbent pad 39 may make the spot cleaner 30 more effective by removing large amounts of the spot (e.g., pet feces) before the first absorbent pad 32 and cleaner 34 are applied to the spot. In some embodiments, the third absorbent pad 39 may have the ability to be removed (e.g., torn away) from the spot cleaner 30 to allow the soiled third absorbent pad 39 to be discarded.

A method of cleaning a spot 100 from a localized area 101 will now be described with reference to 14A-14D. The method includes positioning a spot cleaner 10 near the localized area 100. The spot cleaner 10 includes a first absorbent pad 12 and a second absorbent pad 16. The first absorbent pad 12 includes a cleaner 14. The spot cleaner 10 further includes a moisture proof barrier 18 that is between the first and second absorbent pads 12, 16. The moisture proof barrier 18 encloses the first absorbent pad 12 to keep the cleaner 14 within the moisture proof barrier 18.

Figure 14A:
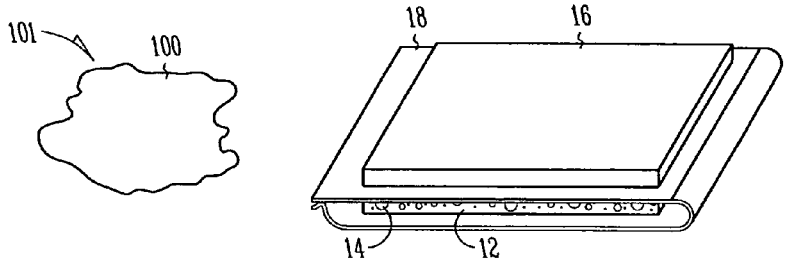
FIGS. 14A-14D illustrate an example embodiment of a method of cleaning a spot from a localized area.
Figure 14B:
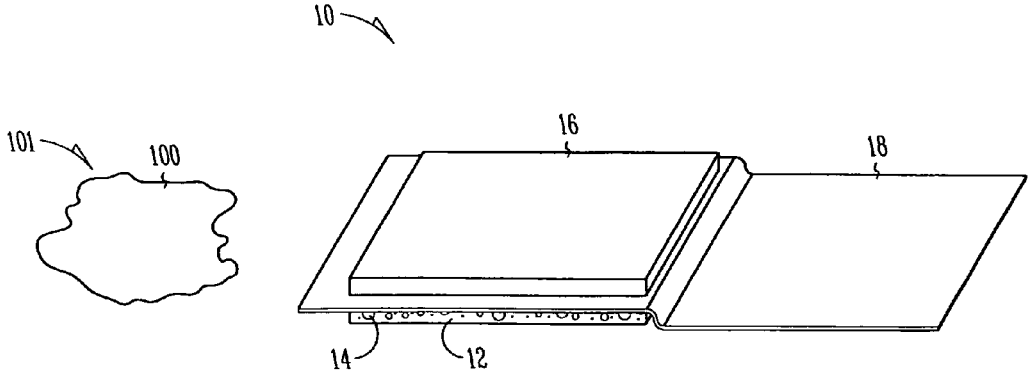
Figure 14C:
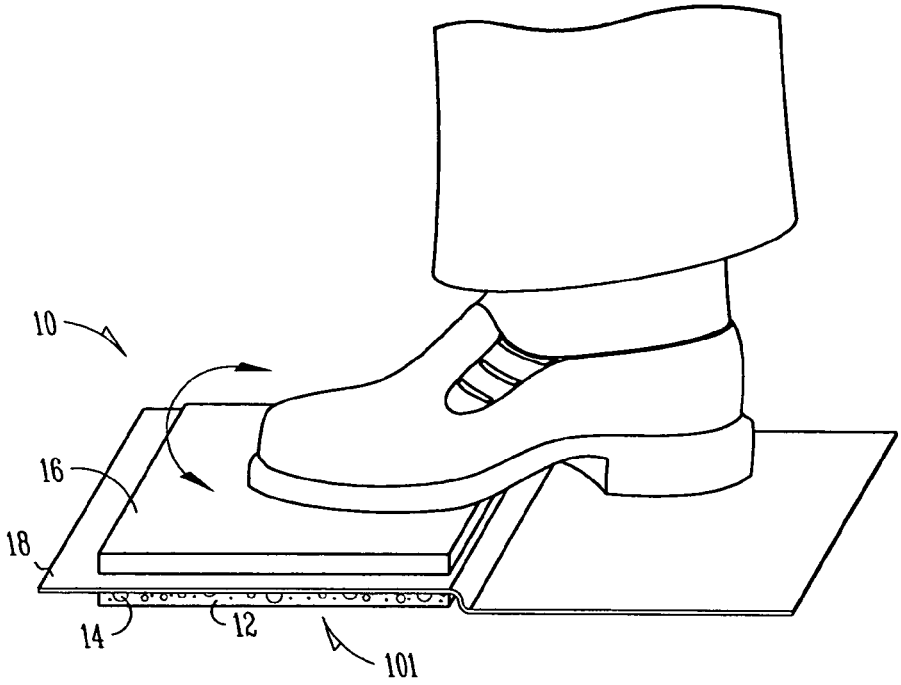
Figure 14D:
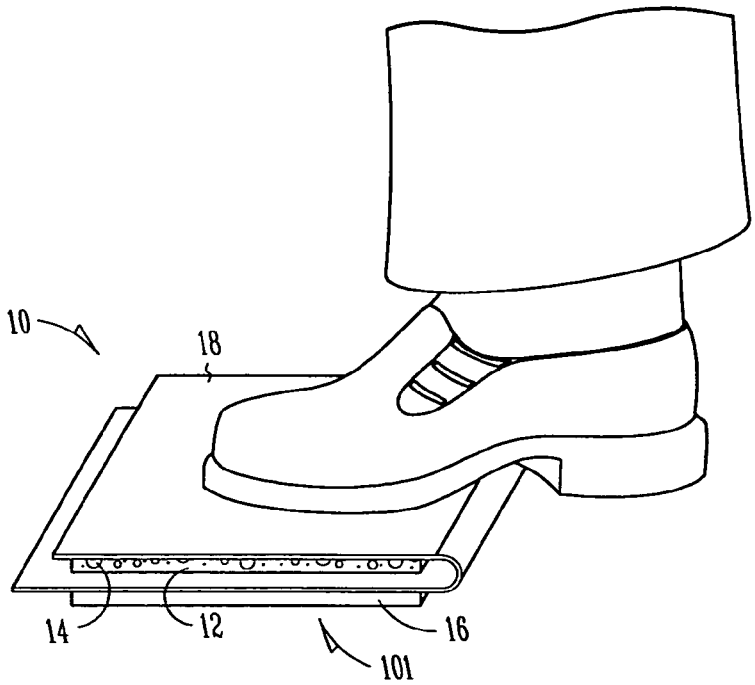

The method further includes manipulating the moisture proof barrier 18 to expose the first absorbent pad 12 (FIG. 14B), and holding the first absorbent pad 12 against the localized area 101 such that the cleaner 14 disengages the spot 100 from the localized area 101 (see FIG. 14C where spot 100 is not visible because it is under spot cleaner 10). The method further includes absorbing at least some of the cleaner 14 and at least some of the disengaged spot 100 from the localized area 101 using the second absorbent pad 16 (FIG. 14D). As shown in FIG. 14D, the method may further include covering the first absorbent pad 12 with the moisture proof barrier 18 after the cleaner 14 disengages the spot 100 from the localized area 101.

In some embodiments, the moisture proof barrier 18 may be a layer such that manipulating the moisture proof barrier 18 includes peeling a portion of the layer back from the rest of the moisture proof barrier 18 in order to expose the first absorbent pad 12 and cleaner 14 (FIG. 14B). In other embodiments, the moisture proof barrier 18 may include a weakened section (not shown) such that manipulating the moisture proof barrier 18 to expose the first absorbent pad 12 may include tearing the weakened section of the moisture proof barrier 18 to remove a portion of the moisture proof barrier 18. As shown in FIG. 14C, holding the first absorbent pad 12 against the localized area 101 may include mechanically agitating the localized area 101 with the first absorbent pad 12 (e.g., by using a foot or hand).

In some embodiments, the spot cleaner 10 may include a third absorbent pad (not shown in FIGS. 14A-14D) such that the moisture proof barrier 18 is between the first absorbent pad 12 and the third absorbent pad. If the spot cleaner 10 includes a third absorbent pad, the method may further include initially engaging the third absorbent pad with the localized area 101 to absorb some of the spot 100 from the localized area 101 before the first absorbent pad 12 and cleaner 14 engage the spot 100. The method may further include removing the third absorbent pad from the spot cleaner 10 after some of the spot 100 has been absorbed from the localized area 101 using the third absorbent pad.

Figure 15A:
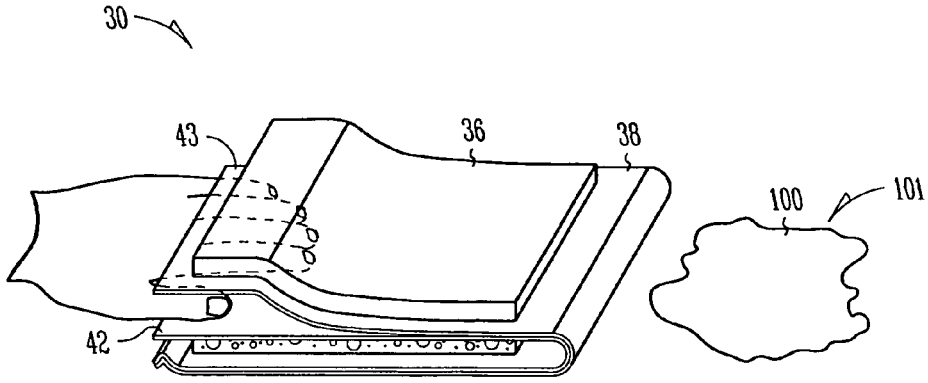
FIGS. 15A-15C illustrate another example embodiment of the method of cleaning a spot from a localized area.

Another method of cleaning a spot 100 from a localized area 101 will now be described with reference to FIGS. 15A-15C. The method includes positioning a spot cleaner 30 near the localized area 100 (FIG. 15A). The spot cleaner 30 includes a first absorbent pad 32 and a second absorbent pad 36. The first absorbent pad 32 includes a cleaner 34. The spot cleaner 30 further includes a moisture proof barrier 38 that is between the first and second absorbent pads 32, 36. The moisture proof barrier 38 encloses the first absorbent pad 32 to keep the cleaner 34 within the moisture proof barrier 38.

Figure 15B:
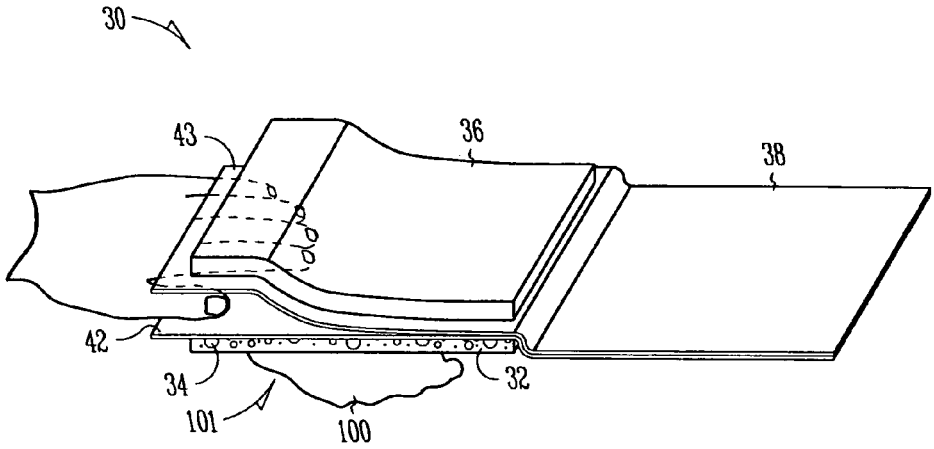
Figure 15C:
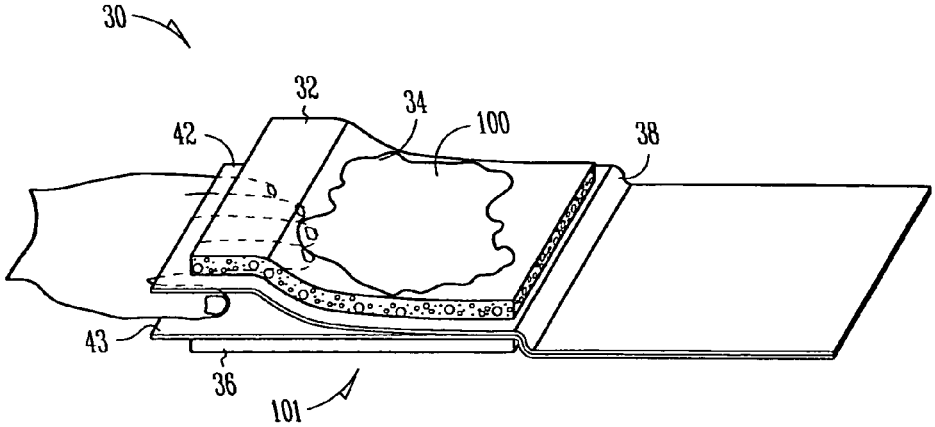

The method further includes manipulating the moisture proof barrier 38 to expose the first absorbent pad 32 and the cleaner 34 (FIG. 15B), and holding the first absorbent pad 32 against the localized area 101 such that the cleaner 34 disengages the spot 100 from the localized area 101 (FIG. 15B). FIG. 15C shows that the method further includes absorbing the cleaner 34 and the disengaged spot 100 from the localized area 101 using the second absorbent pad 36.

It should be noted that not all of the cleaner 34 may be distributed from the first absorbent pad 32 to the localized area 101 where the spot 100 is located. In addition, some of the spot 100 may be absorbed into the first absorbent pad 32 when the first absorbent pad 32 engages the spot 100 (see FIG. 15C).

In some embodiments, the moisture proof barrier 38 may include a first layer 42 that is attached to the first absorbent pad 32 and a second layer 43 that is attached to the second absorbent pad 36. When the moisture proof barrier 38 of the spot cleaner 30 includes first and second layers 42, 43, the method may further include inserting a hand 45 between the first layer 42 and the second layer 43 (FIGS. 15A-15C).

It should be noted that holding the first absorbent pad 32 against the localized area 101 may include pressing the first absorbent pad 32 against the localized area 101 using the hand 45 (FIG. 15B). In addition, absorbing the cleaner 34 and the disengaged spot 100 from the localized area 101 may include pressing the second absorbent pad 36 against the localized area 101 using the hand 45 (FIG. 15C).

The operations discussed above with respect to the described methods may be performed in a different order from those described herein. In addition, FIGS. 1-15 are representational and are not necessarily drawn to scale. Certain proportions thereof may be exaggerated, while others may be minimized.

The spot cleaners and methods described herein may allow individuals to quickly and readily clean a spot from a localized area. In addition, the spot cleaners may be formed in multiple sizes and/or include different types of cleaners such that an appropriate size/type of spot cleaner may be selected depending on the size and type of spot, and the type of substrate.

While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

We claim:

1. A spot cleaner comprising:

a first absorbent pad that includes a cleaner;

a second absorbent pad; and a moisture proof barrier between the first absorbent pad and the second absorbent pad, the moisture proof barrier enclosing the first absorbent pad, wherein the moisture proof barrier includes a first section, a second section and a fold that separates the first section from the second section, the first section being between the first and second absorbent pads.

2. The spot cleaner of claim 1 wherein the cleaner includes a liquid solution.

3. The spot cleaner of claim 1 wherein the first absorbent pad is formed of a material with large capillary structure so that first absorbent pad readily releases the cleaner.

4. The spot cleaner of claim 1 wherein the second absorbent pad is formed of a combination of a wettable spunbond material and a meltblown material.

5. The spot cleaner of claim 1 wherein the first absorbent pad has a capillary structure that is larger than a capillary structure of the second absorbent pad.

6. A spot cleaner comprising: a first absorbent pad that includes a cleaner; a second absorbent pad; a third absorbent pad; and a moisture proof barrier between the first absorbent pad and the third absorbent pad, the moisture proof barrier enclosing the first absorbent pad.

7. The spot cleaner of claim 6 wherein the third absorbent pad is removable from the moisture proof barrier.

8. The spot cleaner of claim 6 wherein the third absorbent pad is formed of a combination of a wettable spunbond material and a meltblown material.

9. A spot cleaner comprising:

a first absorbent pad that includes a cleaner;

a second absorbent pad; and a moisture proof barrier that includes a first layer attached to the first absorbent pad and a second layer attached to the second absorbent pad, the first and second layers being between the first absorbent pad and the second absorbent pad such that the moisture proof barrier encloses the first absorbent pad.

10. The spot cleaner of claim 9 wherein the cleaner includes a liquid solution.

11. The spot cleaner of claim 9 further comprising a third absorbent pad, the moisture proof barrier being between the first absorbent pad and the third absorbent pad.

12. The spot cleaner of claim 9 wherein the first layer and the second layer are separable to allow a hand to be inserted between the first layer and the second layer.

13. The spot cleaner of claim 9 wherein the first layer encloses the first absorbent pad.

14. The spot cleaner of claim 9 wherein the second layer encloses the first absorbent pad.

15. The spot cleaner of claim 9 wherein the moisture proof barrier includes a first section, a second section and a fold that separates the first section from the second section, the first section being between the first and second absorbent pads.

16. The spot cleaner of claim 9 wherein the moisture proof barrier includes a first section and a second section such that the first section is between the first and second absorbent pads and the second section is removable from the spot cleaner to expose the first absorbent pad.

17. The spot cleaner of claim 9 wherein a portion of the first layer and a portion of the second layer form a mitt.

18. A method of cleaning a spot from a localized area, the method comprising:

positioning a spot cleaner near the localized area; the spot cleaner having a first absorbent pad that includes a cleaner, the spot cleaner further including a second absorbent pad and a moisture proof barrier that is between the first absorbent pad and the second absorbent pad, the moisture proof barrier enclosing the first absorbent pad;

manipulating the moisture proof barrier to expose the first absorbent pad, wherein the moisture proof barrier is either a layer such that manipulating the moisture proof barrier includes peeling one portion of the layer back from another portion of the layer or the moisture proof barrier includes a weakened section such that manipulating the moisture proof barrier includes tearing a weakened section of the moisture proof barrier;

holding the first absorbent pad against the localized area such that the cleaner disengages the spot from the localized area; and absorbing at least some of the cleaner and at least some of the disengaged spot from the localized area using the second absorbent pad.

19. The method of claim 18 further comprising covering the first absorbent pad with the moisture proof barrier after the cleaner disengages the spot from the localized area.

20. The method of claim 18 wherein the moisture proof barrier is a layer such that manipulating the moisture proof barrier includes peeling one portion of the layer back from another portion of the layer.

21. The method of claim 18 wherein the moisture proof barrier includes a weakened section such that manipulating the moisture proof barrier to expose the first absorbent pad includes by tearing the weakened section of the moisture proof barrier.

22. A method of cleaning a spot from a localized area, the method comprising:

positioning a spot cleaner near the localized area; the spot cleaner having a first absorbent pad that includes a cleaner, the spot cleaner further including a second absorbent pad, a third absorbent pad, and a moisture proof barrier that is between the first absorbent pad and the third absorbent pad, the moisture proof barrier enclosing the first absorbent pad;

initially engaging the third absorbent pad with the localized area to absorb some of the spot from the localized area;

manipulating the moisture proof barrier to expose the first absorbent pad;

holding the first absorbent pad against the localized area such that the cleaner disengages the spot from the localized area; and absorbing at least some of the cleaner and at least some of the disengaged spot from the localized area using the second absorbent pad.

23. The method of claim 22 further comprising:

removing the third absorbent pad from the spot cleaner after some of the spot has been absorbed from the localized area using the third absorbent pad.

24. A method of cleaning a spot from a localized area, the method comprising:

positioning a spot cleaner near the localized area; the spot cleaner having a first absorbent pad that includes a cleaner, the spot cleaner further including a second absorbent pad and a moisture proof barrier that is between the first absorbent pad and the second absorbent pad, the moisture proof barrier enclosing the first absorbent pad and including a first layer that is attached to the first absorbent pad and a second layer that is attached to the second absorbent pad, inserting a hand between the first layer and the second layer;

manipulating the moisture proof barrier to expose the first absorbent pad;

holding the first absorbent pad against the localized area such that the cleaner disengages the spot from the localized area; and absorbing at least some of the cleaner and at least some of the disengaged spot from the localized area using the second absorbent pad.

* * * * *